US005174078A

United States Patent [19]

West

[11] Patent Number: 5,174,078

[45] Date of Patent: Dec. 29, 1992

[54] ROOF CONSTRUCTION FOR PLAYHOUSE

[76] Inventor: Gregg West, 18636 Tanterra Way, Brookeville, Md. 20833

[21] Appl. No.: 668,119

[22] Filed: Mar. 12, 1991

[51] Int. Cl.[5] ..... E04H 1/12

[52] U.S. Cl. ..... 52/233; 52/593; 52/90; 446/106; 446/110

[58] Field of Search ..... 446/106, 110; 52/233, 52/593, 90

[56] References Cited

U.S. PATENT DOCUMENTS

| | | | |
|---|---|---|---|
| 1,163,851 | 12/1915 | Pringle | 446/106 |
| 1,271,160 | 7/1918 | Groves | 446/106 |
| 2,059,598 | 11/1936 | Paulson . | |
| 2,110,990 | 3/1938 | Forbes | 446/106 |
| 2,125,580 | 8/1938 | Paulson | 446/106 |
| 2,844,910 | 7/1958 | Korchak . | |
| 3,007,279 | 11/1961 | Korchak . | |
| 4,372,076 | 2/1983 | Beck | 446/106 |
| 4,391,067 | 7/1983 | Frady et al. | 52/233 |

FOREIGN PATENT DOCUMENTS

| | | | |
|---|---|---|---|
| 0596273 | 4/1960 | Canada | 446/106 |
| 0848772 | 7/1949 | Fed. Rep. of Germany | 446/106 |
| 924333 | 3/1946 | France . | |
| 0123754 | 1/1927 | Switzerland | 446/106 |
| 123754 | 12/1927 | Switzerland . | |

*Primary Examiner*—Richard E. Chilcot, Jr.
*Assistant Examiner*—Wynn E. Wood

[57] ABSTRACT

A playhouse constructed of interlocking logs has a water-tight sloped roof formed by overlapping roof sheets. The sheets are secured to the playhouse by means of roof peak pieces notched at their bottom to interlock with respective notches in a tie beam log. The roof peak pieces have sloped surfaces, each with a bore defined therein for receiving a roof peg extending through one of two holes defined through the roof sheet in spaced relation along an upper edge of the roof sheet. Adjacent roof sheets in the roof structure overlap such that one peg may be inserted through aligned holes in each sheet and into a common roof peak piece bore.

14 Claims, 7 Drawing Sheets

FIG. 2h →

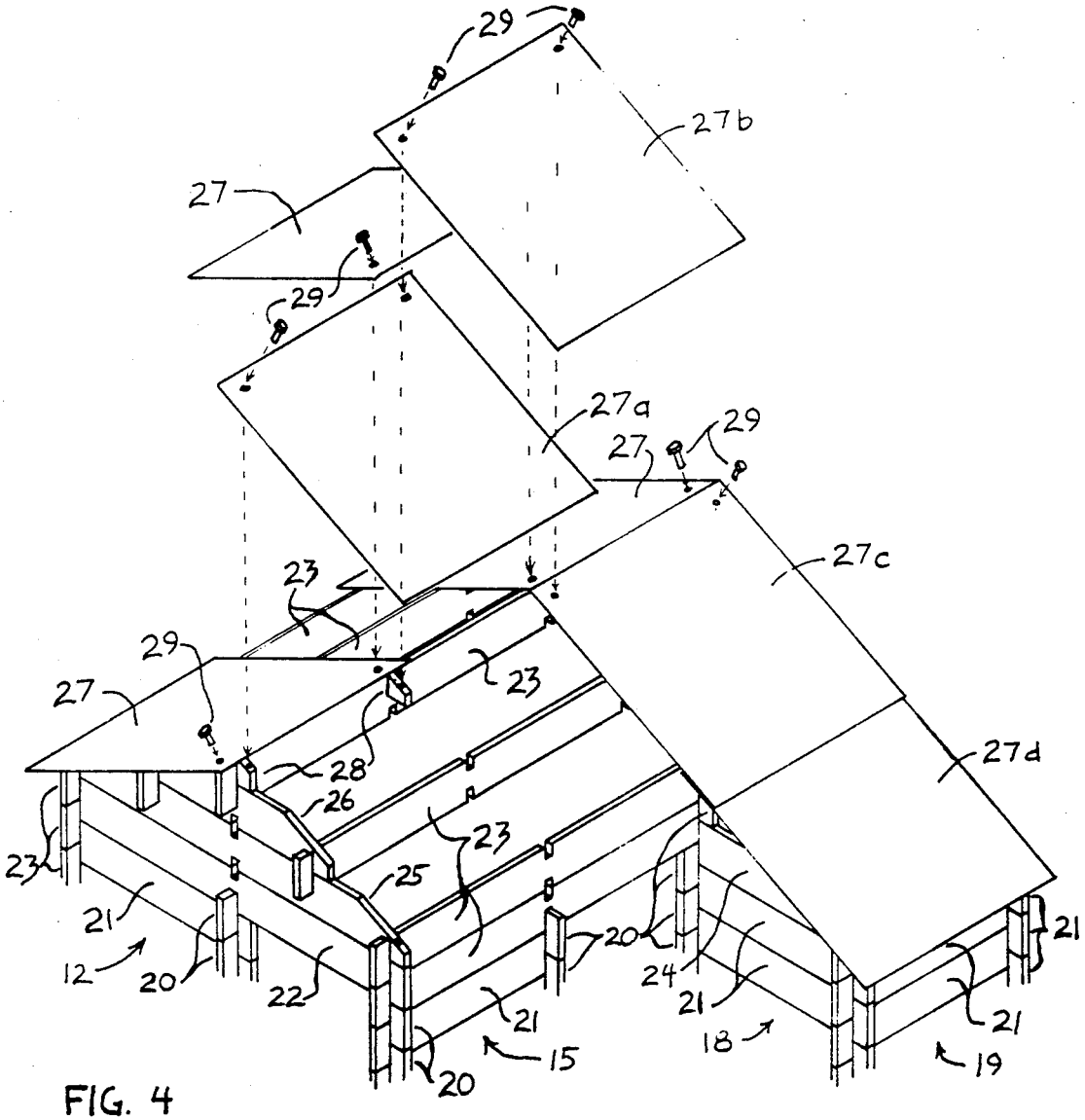
FIG. 4
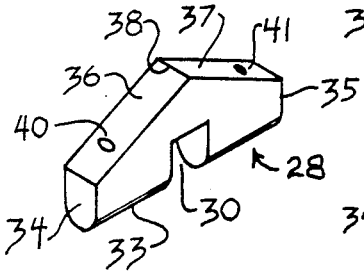
FIG. 5
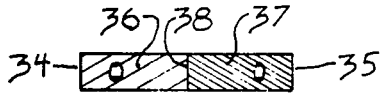
FIG. 6b
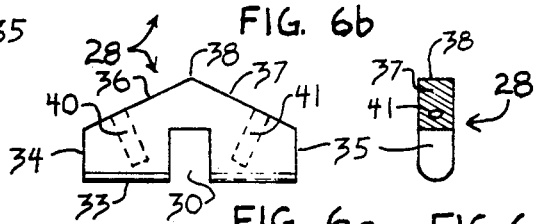
FIG. 6a
FIG. 6c
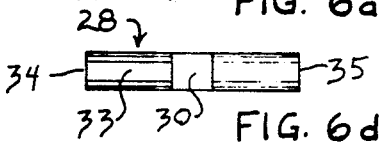
FIG. 6d

ROOF CONSTRUCTION FOR PLAYHOUSE

BACKGROUND OF THE INVENTION

1. Technical Field:

The present invention relates to children's playhouses of the type that are built from interlocking logs and other components supplied in kit form. More particularly, the present invention relates to improved roof components and construction for such playhouses.

2. Description of the Prior Art:

It is known in the prior art to build toy-size houses out of interlocking log-like pieces. By toy-size it is meant that the components and houses are on the order of a few inches in height, depth and width and are clearly incapable of being entered by adults. Examples of this are found in U.S. Pat. Nos. 1,271,160 (Groves), 2,059,598 (Paulson), 2,844,910 (Korchak) and 3,007,279 (Korchak). In addition, it is known to build cabin-like dwellings for humans out of similar but larger components, examples being found in French Patent No. 924,333 (Cyreaque) and Swiss Patent No. 123,754 (Bosshard). The present invention is concerned with playhouses constructed from interlocking logs and other components. As used herein, "playhouse" refers to structures that can be erected and then entered by children in an approximate age range of five to twelve years, but which are too small and of insufficiently permanent construction to serve as dwellings.

It is essential that playhouses have sufficient structural strength and stability as not to collapse when climbed on and in by children. In addition, the structure should have a water-tight roof so that it does not leak when exposed to rain. Further, the structure should be capable of assembly by a five or six-year old. The prior art toy-size houses referred to above have insufficient structural strength and stability and lack a water-tight roof. The dwelling size units are too complex to be assembled by children, particularly the dwelling roofs.

OBJECTS AND SUMMARY OF THE INVENTION

Accordingly, it is a primary object of the present invention to provide a method and apparatus for constructing a playhouse from interlocking logs and other components whereby the resulting structure is easily erected by a five year old, is sufficiently strong to be climbed in and on, and has an easily assembled roof that prevents rain from leaking into the interior space.

It is another object of the present invention to provide unique components for assembling a safe and water-tight roof for engaging the top of a playhouse constructed from interlocking logs.

In accordance with the present invention, a playhouse constructed from interlocking logs has a sloped roof formed by sheet members secured to a gable tie beam by plural unique roof peak pieces. Each roof peak piece has a notch on its bottom edge for residing in and engaging a corresponding notch in the gable tie beam. The top of each roof peak piece is sloped to match the slope of the roof of the structure and is provided with a hole adopted to receive the stem of a retainer peg having a radially enlarged head. Each roof sheet is provided with a plurality of apertures or holes adjacent one edge, i.e., the uppermost edge when the roof sheet is mounted. The roof sheet apertures are spaced to correspond to the notch spacing along the gable tie beam and thereby can be aligned with bores in corresponding roof peak pieces engaged by the beam. The pegs are inserted through the roof sheet apertures into the bores in the roof peak pieces so that the roof sheet is suspended from its uppermost edge by the pegs and rests on the gable edges and other tie beams in a sloped orientation. The width of the roof sheets is such that the sheets overlap along their adjacent sloped edges. In the preferred embodiment, this overlap results in alignment of an aperture in each sheet such that a single peg may be inserted through aligned sheet apertures of two sheets and into an aligned bore in a roof peak piece. If the length of the roof requires more than one roof sheet, the length is such that adjacent upper and lower edges, respectively, of adjacent sheets similarly overlap.

BRIEF DESCRIPTION OF THE DRAWINGS

These and other objects, features and many of the attendant advantages of the present invention will be appreciated more readily as they become better understood from a reading of the following description considered in connection with the accompanying drawings wherein like parts in each of the several figures are identified by the same reference characters and, wherein:

FIGS. 2*a* through 2*j* are side views in elevation of respective components parts utilized in constructing the playhouse of FIG. 1;

FIG. 4 is an exploded view in perspective of the upper portion of the playhouse of FIG. 1 showing the roof sheets and pegs;

FIG. 5 is a view in perspective of the roof peak piece of the present invention;

FIGS. 6*a*, 6*b*, 6*c* and 6*d* are front elevation, top plan, side elevation and bottom plan views, respectively, of the roof peak piece of FIG. 5.

DESCRIPTION OF THE PREFERRED EMBODIMENTS

Figure 1:
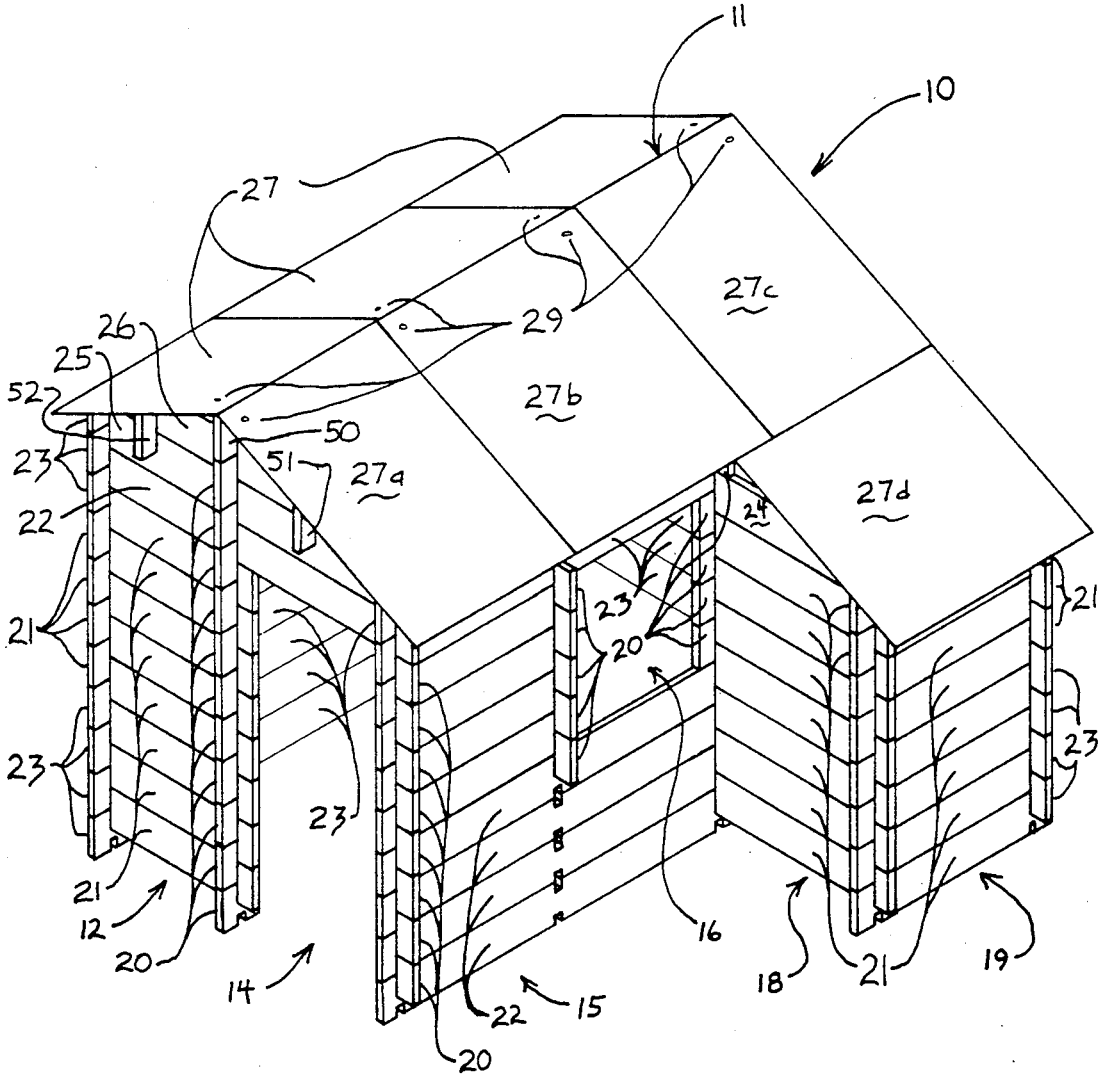
FIG. 1 is a view in perspective of a playhouse constructed in accordance with the present invention.

A children's playhouse 10 constructed in accordance with the present invention is illustrated in FIG. 1 of the accompanying drawings. The playhouse is designed to be constructed by one or more children, ages five through twelve, from pieces 21 through 29, inclusive, described in greater detail below in relation to FIGS. 2*a* through 2*j*, inclusive. Playhouse 10 has a ridge roof, the ridge 11 extending longitudinally (i.e., lengthwise) of the playhouse between a front wall 12 and a rear wall 13 (not visible in FIG. 1 but visible in FIG. 3) disposed in parallel relation. Both front wall 12 and rear wall 13 have gable ends at their top. An access opening 14, in the form of a doorway, is defined in front wall 12. A right side wall 15 extends perpendicularly rearward from one end of front wall 12 and has a window opening 16 defined therein. A left side wall 17 (visible only in FIG. 3) extends perpendicularly rearward from the opposite end of front wall 12. Side wall 17 extends the entire length of the playhouse from front wall 12 to rear wall 13; side wall 15, however, is shorter and terminates in perpendicular intersection with a relatively short wall 18 projecting to the right of side wall 12. Wall 18, oriented parallel to front wall 12 and rear wall 13, terminates in perpendicular intersection with one end of a further wall 19 extending parallel to side walls 15 and 17. The other end of wall 19 terminates at the right end of rear wall 13, the latter being elongated, relative to front wall 12, for that purpose.

In order to serve as a children's playhouse, the structure must be scaled so that children can enter and play in its interior, and must be sufficiently structurally sound to permit children to climb on the structure. As an example of the size of the structure, its height, from the ground to ridge 11, is approximately six feet. Front wall 12 is approximately five feet long, with doorway 14 approximately four feet high and two feet wide. Side walls 15 and 17 are approximately five feet and seven feet long, respectively, and window opening 16 is approximately two feet by two feet square. Rear wall 13 is approximately seven feet long, and walls 18 and 19 are approximately two and one-half feet long. The slope of the roof relative to horizontal is approximately twenty to twenty-five degrees.

Playhouse 10 is easily assembled from multiple interlocking pieces without the need for adhesives, nails, screws or other fastening means. These pieces, a plurality of each being present in a typical kit, include log-like members 21 (FIG. 2*b*), 22 (FIG. 2*c*), 23 (FIG. 2*d*), 24 (FIG. 2*e*), 25 (FIG. 2*f*), and 26 (FIG. 2*g*). Log-like members 21, 22 and 23 have generally rectangular longitudinal and transverse sections and have different lengths but have the same height and thickness. Typical lengths for member 21 is thirty-two inches, for member 22 is fifty-eight inches, and for member 23 is eighty-four inches. The width of these members (i.e., vertically in the drawing) is typically five and three-quarters inches, and the thickness (i.e., into the plane of the drawing) is typically one and one-eighth inch. Member 24 is similar in size and configuration to member 21 but has one upper corner truncated at approximately the slope of the roof of playhouse 10. Members 25 and 26 are similar to members 22 and 21, respectively, but have both upper corners truncated at approximately the angle of the roof slope.

Figure 2A:
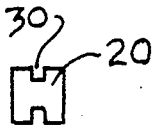
Figure 2B:
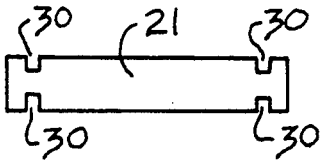
Figure 2C:
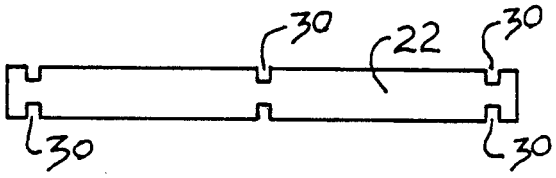
Figure 2D:
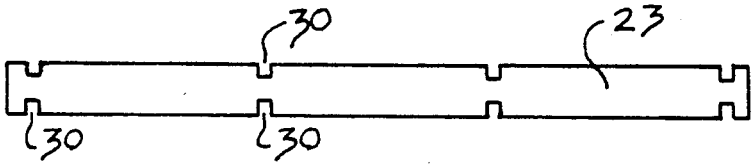
Figure 2E:
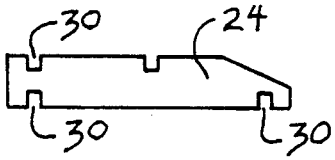
Figure 2F:
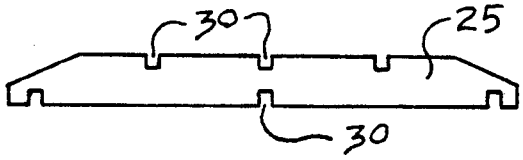
Figure 2G:
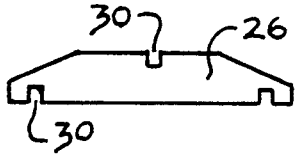
Figure 2G:
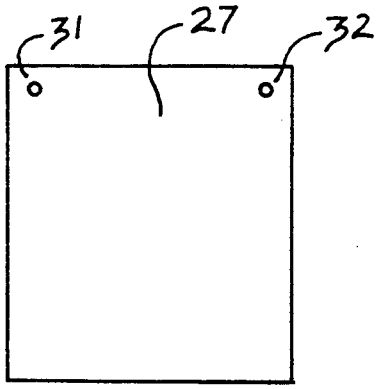

A further type of piece employed in multiple locations in the playhouse is interconnection piece 20 (FIG. 2*a*). This piece has rectangular longitudinal and transverse sections and is typically six inches long; its width and thickness are the same as those of members 21, 22 and 23.

Pieces 20 through 26 are each provided with plural recess notches 30 of standardized configuration to permit secure interengagement between the members. The recess notches 30 are typically rectangular notches extending widthwise into the member from predetermined spaced locations on its longitudinally-extending sides or edges. The recess notches are typically one and onequarter inch long (i.e., along the length of the member) and one and one-half inch deep (i.e., into the width of the member). All of the notches extend entirely through the thickness dimension of the member. Interconnection piece 20 has one notch 30 centered in each longitudinal side. Member 21 has two pairs of notches 30, each pair being transversely aligned in opposite longitudinally extending sides with the notch centers spaced approximately three inches from respective ends of the member. Member 22 has three pairs of transversely aligned notches 30, two pairs being disposed with their centers three inches from respective member ends, the other pair being centered lengthwise of the member. Member 23 has four pairs of notches 30, two pairs located at respective ends and two other pairs located such that the spacings between each successive pair are equal. In the described embodiment, the spacing between successive notch pairs on each of members 21, 22 and 23 is approximately twenty-six inches.

Member 24 has two notches 30 defined in its bottom longitudinal side with notch centers located three inches from respective ends of the member. The top longitudinal side of member 24 has one notch paired with a notch in the bottom side proximate the non-truncated end of the member, a second notch is centered lengthwise of the top side. Member 25 has three notches in its bottom side positioned in the same manner as the notches in member 22; the top side of member 25 has one longitudinally centered notch and two notches spaced on opposite sides of the center notch by one-half of the predetermined notch spacing along the bottom side. Member 26 has two notches in its bottom side similar to the notches in member 21; a single notch in the top side is centered longitudinally.

In constructing playhouse 10, various members 20 through 26 are interlocked in a conventional manner by placing a notch of one member into a notch of another member with the members in perpendicular orientation. This interlocking arrangement has been used with similar but smaller scale members in toy houses, and with similar but large scale members for dwellings. The arrangement of members 20 through 26 for constructing playhouse 10 is illustrated in FIGS. 1, 3 and 4. The unique roof construction of playhouse 10 is described immediately below with reference to FIGS. 2*h*, 2*i*, 2*j*, 5 and 6*a* through 6*d*.

The roof of playhouse 10 is covered with a plurality of rectangular roof sheets or shingles 27 typically constructed of rigid sheet material capable of supporting the weight of a child climbing on the roof. The sheets are typically one-quarter inch thick, thirty-two inches wide along their upper and lower edges, and thirty-five inches along their side edges. Each sheet has two holes or apertures 31, 32 defined through its thickness in spaced relation proximate the upper edge of the sheet. The diameter of holes 31, 32 is typically seven-sixteenths inch; and the center of the holes is positioned two inches from the top edge of the sheet and three inches from a respective long side. It will be noted that this leaves the centers of holes 31 and 32 spaced from one another by twenty-six inches, the same spacing that exists between successive notches 30 in members 21, 22 and 23.

Figure 2I:
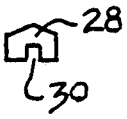
Figure 3:
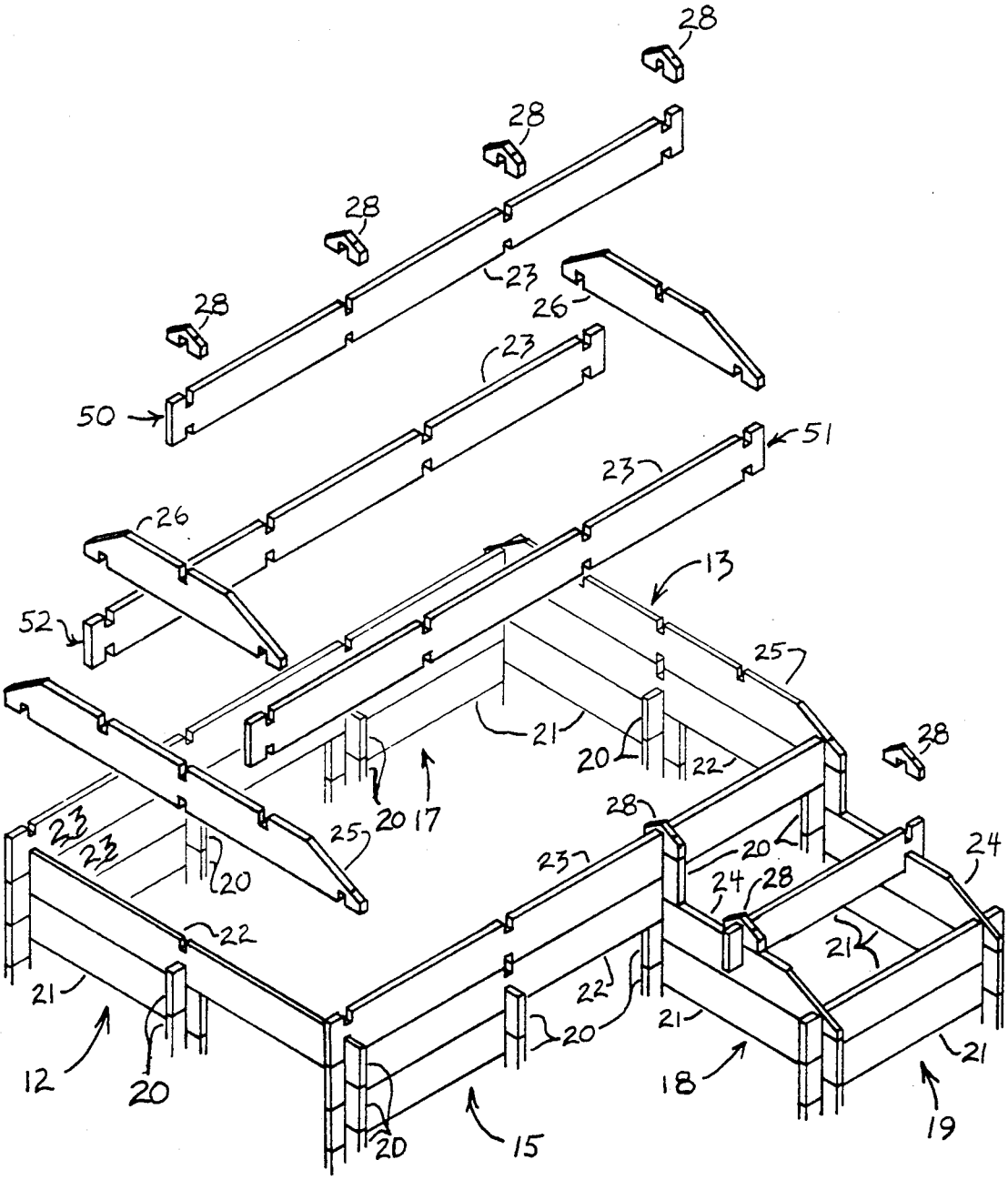
FIG. 3 is an exploded view in perspective of the upper portion of the playhouse of FIG. 1 without its roof sheets and pegs.

The roof of playhouse 10 also includes multiple roof peak pieces 28 (FIG. 2*i*). These pieces are formed of the same material as members 20 through 26 and have the same thickness (i.e., one and one-eighth inch) and length (i.e., six inches) as interconnecting member 20. The bottom edge 33 of piece 28 may be planar or rounded and has a standard recess notch 30 longitudinally centered therein. Two vertical sides 34, 35 extend upwardly from the bottom edge to a height of approximately one and three-quarters inch. A top edge is defined as two converging top surfaces 36, 37 extending from respective vertical sides 34, 35 to an intersection line 38 at the same angle as the slope of the roof (i.e., nominally twenty degrees to twenty-five degrees). The intersection line 38 resides in a vertical plane about which the entire roof peak piece 28 is symmetrical.

Each top surface 36, 37 has a respective cylindrical bore 40, 41 defined therein and oriented perpendicular to the surface. Each bore 40, 41 is typically three-eighths inch in diameter and one and one-half inch deep. The openings of bores 40 and 41 in surfaces 36 and 37, respectively, are centered in the thickness dimension of piece 28 but closer to sides 34 and 35, respectively than to intersection line 38. Specifically, the distance between the center of bores 40, 41 from sides 34, 35, respectively, is approximately one-half the distance from the bore centers to peak 38.

Figure 2J:
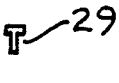

The final elements required for the roof construction for playhouse 10 are roof pegs 29 (FIG. 2*j*). These pegs each have an axially short head of hexagonal or circular transverse crosssection from which a long cylindrical stem extends centrally of one head surface. The peg head typically has a one-half inch maximum diameter and a three-sixteenths inch length. The stem typically has a five-sixteenth inch diameter and a one and one-half inch length. In the preferred embodiment, peg 29 is a steel hexagonal head bolt.

Important relationships exist between the sizes and configurations of the roof peak piece bores 40, 41, the holes 31, 32 in roof sheet 27, and the roof peg 29. Specifically, the diameter of the stem of peg 28 must fit through roof sheet holes 31, 32 and the bores 40, 41 in roof peak piece 28. The diameter of the peg head must be larger than the diameter of holes 31, 32. The length of the peg stem must also be sufficient to extend through roof sheet holes 31, 32 at least halfway into bores 40, 41.

The roof of playhouse 10 is assembled after the remainder of the structure has been assembled so as to provide gable ends atop each of walls 12 and 13. In this regard, each gable end includes a long truncated member 25 disposed atop a member 23, and a short truncated member 26 disposed atop the long truncated member 25. The top notch 30 in the top side of short truncated member 26 at the upper end of front wall 12 is longitudinally aligned with a similar notch 30 in the short truncated member 26 atop rear wall 13. Accordingly, an upper tie beam 50, corresponding to a member 23, is interlocked with both walls 12 and 13 by placing the notches 30 at opposite ends of the bottom of the upper tie beam 50 into the centered notches 30 in the top sides of the two short truncated members 26. Two lower tie beams 51, 52, also corresponding to respective members 23 are disposed below and on opposite transverse sides of upper tie beam 50. Lower tie beam 51 is disposed closer to side wall 15; lower tie beam 52 is disposed closer to side wall 17. Both lower tie beams are interlocked at their end pairs of notches with notches in the bottom side of short truncated member 26 and in the top side of long truncated member 25.

Each of the four notches 30 in the upper side of upper tie beam 50 receives the bottom notch of a respective roof peak piece 28. As a consequence, the top intersection lines 38 of the four roof peak pieces 28 define a straight line extending longitudinally along the playhouse top and defining the roof ridge. As best illustrated in FIG. 4, a first roof sheet **27*a* is disposed atop the two roof peak pieces 28 closest to front wall 12 so as to rest on lower tie beam 51. The two holes 31, 32 in roof sheet 27*a* are aligned with bores 40 in those two roof peak pieces, and respective roof pegs 29 are inserted through the holes 31 and 32 into bores 40 to secure the roof sheet in place. The roof sheet is thus mounted on the upper tie beam 50 and supported on lower tie beam 51. The roof sheet extends beyond the lower tie beam 51 in sloping relation to also rest on the top side of the upper most member of side wall 15. In this regard, the roof sheet is long enough to overhang side wall 15**.

A second roof sheet **27*b* is disposed adjacent roof sheet 27*a* with its upper edge in longitudinal alignment with the upper edge of roof sheet 27*a*. Adjacent edges of roof sheets 27*a* and 27*b* are placed in partially overlapping relation and, particularly, with hole 31 of sheet 27*b* aligned with hole 32 of sheet 27*a*. In this regard, a common roof peg 29 extends through both of these holes into a bore 40 in the underlying roof peak piece 28**. The overlapped adjacent edges of the roof sheets serve as a closure against precipitation falling directly through the roof and into the playhouse interior.

A third roof sheet **27*c* is similarly disposed along the other side of sheet 27*b* in partial overlapping relation such that hole 32 in sheet 27*b* is aligned with hole 31 in sheet 27*a* whereby one roof peg can extend through both of these holes into a roof peak piece bore. Roof sheet 27*c* overhangs the upper portion of the playhouse extension formed by walls 18 and 19. A fourth roof sheet 27*d* primarily covers that extension and is supported by roof pegs 29 and roof peak pieces 28 that are not visible in FIG. 4 because they are disposed beneath the overlapping bottom section of sheet 27*c***.

The side of the roof between upper tie beam 50 and lower tie beam 52 is constructed with three additional roof sheets 27 arranged and supported in a manner similar to that described in connection with roof sheets **27*a*, 27*b* and 27*c*. The additional roof sheets are secured in bores 41 of the same roof peak pieces 28 that support sheets 27*a*, 27*b* and 27*c* on upper tie beam 50**.

Figure 7:
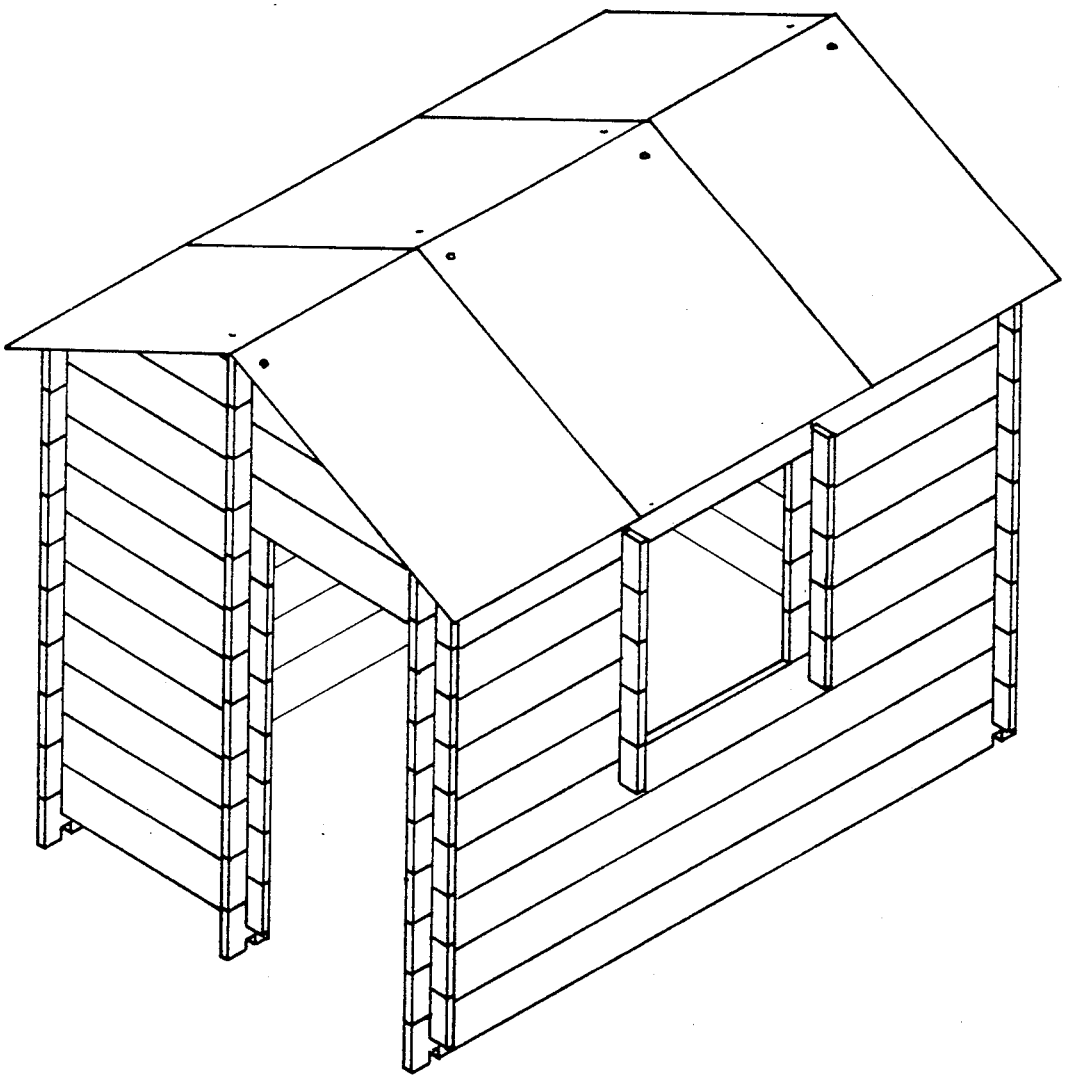
FIGS. 7, 8 and 9 are views in perspective of respective alternate playhouse structures that can be constructed with the component parts illustrated in FIGS. 2*a* through 2*j*.
Figure 8:
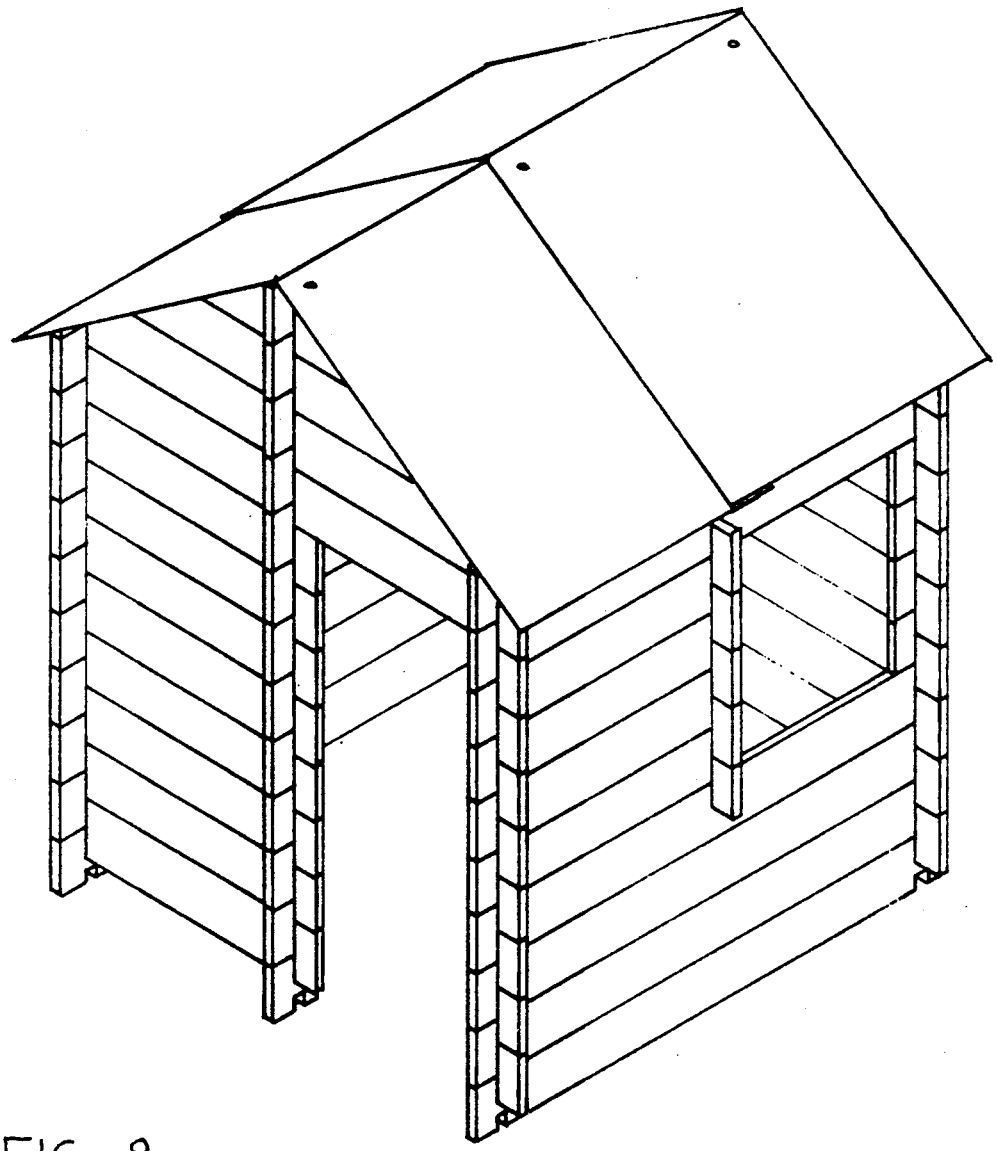
Figure 9:
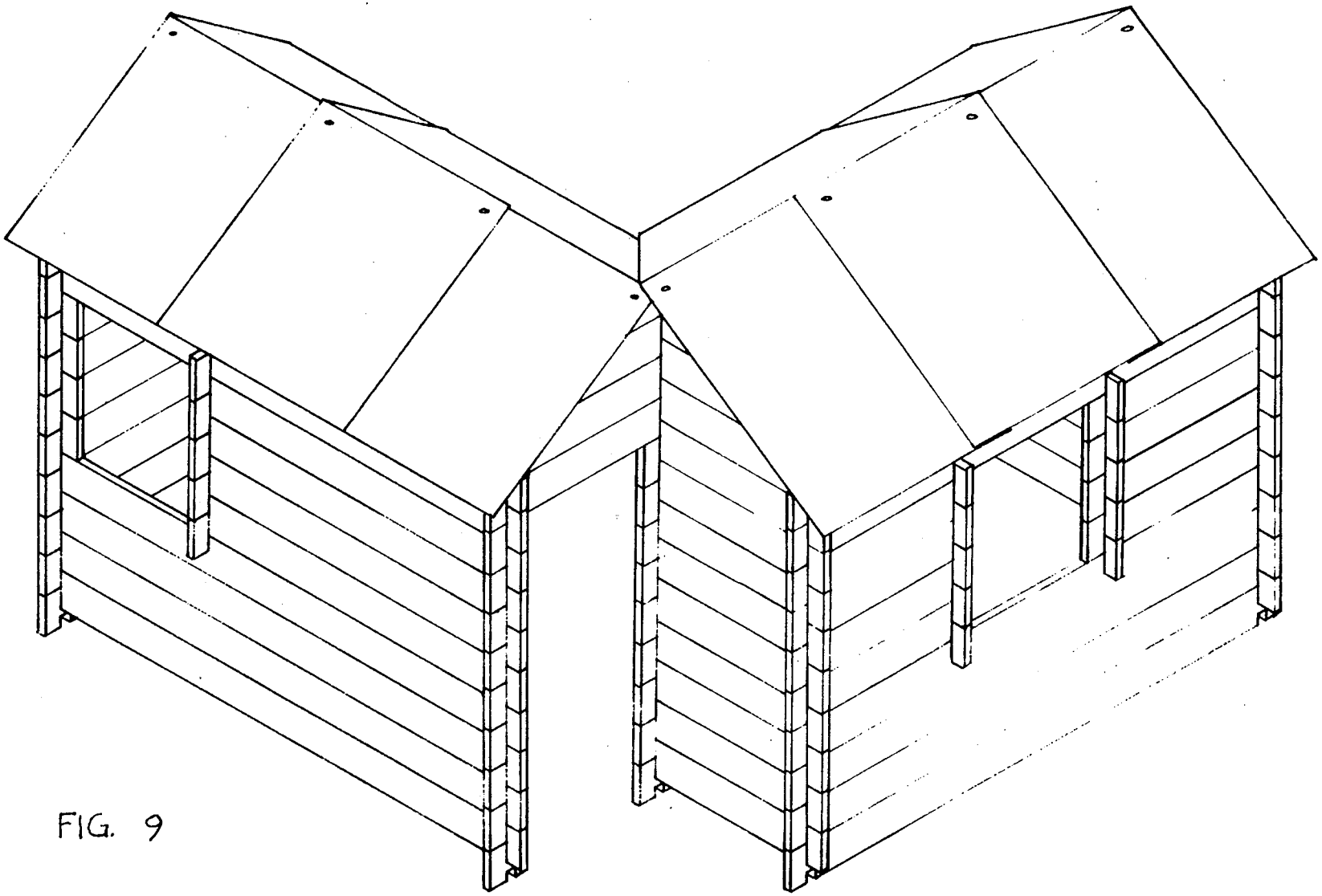

The particular playhouse construction illustrated in FIGS. 1, 3 and 4 is not the only playhouse configuration for which the roof construction of the present invention is applicable. For example, the playhouse configurations illustrated in FIGS. 7, 8 and 9 are similarly adaptable to the roof construction features of the present invention. Still other playhouse configurations, for example of the lean-to type, can be constructed using the roof arrangement of the present invention.

Having described preferred embodiments of a new and improved playhouse with an improved roof construction in accordance with the present invention, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A child's playhouse constructed of multiple interlocking log-like members, each member having first and second opposite sides extending longitudinally of the member and at least one recess notch extending transversely into the member from prescribed locations along the first and second sides to permit interlocking of said members at said recess notches, said playhouse having first and second longitudinally spaced walls and being characterized by a roof construction comprising:

an upper tie beam comprising one of said members extending between said first and second walls and having at least a first and second of said recess notches opening upward at locations longitudinally spaced by a predetermined distance;

a first lower tie beam comprising another of said members extending parallel to said upper tie beam at a location lower than and transversely spaced from said upper tie beam, whereby the upper and first lower tie beams define a first sloped plane disposed at an acute angle to horizontal;

first and second roof peak pieces disposed in said first and second recess notches, respectively, of said upper tie beam, each roof peak piece including; a bottom edge having a recess notch defined therein and configured to interlock with a respective one of said first and second recess notches in said upper tie beam; and a top edge having at least one top surface oriented substantially at said acute angle to horizontal, said roof peak piece having a bore defined therein at said one top surface;

a first roof sheet disposed upon and extending between said upper and lower tie beams, said roof sheet having an upper edge oriented longitudinally along said upper tie beam, wherein first and second holes are defined through said roof sheet at longitudinally spaced locations adjacent said upper edge, the spacing between said holes being substantially the same as the predetermined spacing between said first and second recess notches such that said first and second holes overlie said bores in said first and second roof peak pieces, respectively; and first and second roof pegs extending through said first and second holes, respectively, in said roof sheet and into said bores in said first and second roof peak pieces, respectively, to mount said roof sheet to said upper tie beam via said roof peak pieces;

wherein the playhouse is scaled to permit children to enter and play interiorly thereof.

2. The playhouse according to claim 1 wherein said roof construction is a ridge roof and wherein:

said roof peak pieces each include a second top surface converging upwardly toward said one top surface and intersecting said one top surface at an intersection line vertically aligned with the recess notch defined in said bottom edge, said second top surface having a bore defined therein, wherein said first and second top surfaces are symmetrical about a vertical plane extending through said intersection line;

said playhouse further comprising:

a second lower tie beam comprising a further one of said members extending parallel to said upper tie beam at a location lower than said upper tie beam and transversely displaced on the opposite side of said upper tie beam from said first lower tie beam, whereby said upper and second lower tie beams define a second sloped plane intersecting said first sloped plane and disposed at an angle to horizontal that is substantially supplementary to said acute angle;

a second roof sheet disposed above said upper and second lower tie beams, said second roof sheet having an upper edge oriented longitudinally along said upper tie beam to define a roof ridge with the upper edge of said first roof sheet, wherein third and fourth holes are defined through said second roof sheet at longitudinally spaced locations adjacent its upper edge, the spacing between said third and fourth holes being substantially the same as the predetermined spacing between said first and second recess notches such that said third and fourth holes overlie said bores in the second top surfaces of said first and second roof pieces, respectively; and third and fourth roof pegs extending through said third and fourth holes, respectively, into said bores in said second top surfaces, respectively, to mount said second roof sheet to said upper tie beam via said roof peak pieces.

3. The playhouse according to claim 2 wherein said upper tie beam has at least a third of said recess notches opening upward at a location spaced longitudinally from said second recess notch by said predetermined distance, said playhouse further comprising:

a third roof peak piece disposed in said third recess notch of said upper tie beam and including: a bottom edge having a recess notch defined therein and configured to interlock with said third recess notch in said upper tie beam; and a top edge having at least one top surface oriented substantially at said acute angle to horizontal, said roof peak piece having a bore defined therein through said one top surface;

a third roof sheet disposed upon and extending between said upper and first lower tie beams in partial overlapping relation with said first roof sheet, said third roof sheet having an upper edge oriented longitudinally along said upper tie beam, wherein fifth and sixth holes are defined through said third roof sheet at longitudinally spaced locations adjacent its upper edge, the spacing between said fifth and sixth holes being substantially the same as the predetermined spacing between said first and second recess notches such that said fifth and sixth holes overlie said bores in said second and third roof peak pieces, respectively, and said fifth hole is aligned with said second hole in said first roof sheet such that said second roof peg extends through said second and fifth holes into the bore in said first top surface of said second roof peak piece; and a fifth roof peg extending through said sixth hole in said third roof sheet and into said bore in said third roof peak piece to mount said third roof sheet to said upper tie beam via said second and third roof peak pieces.

4. The playhouse according to claim 3 wherein said third roof peak piece includes a second top surface converging upwardly toward said one top surface and intersecting said one top surface at an intersection line vertically aligned with the recess notch defined in said bottom edge, said second top surface having a bore defined therein, wherein said one and second top surfaces are symmetrical about said vertical plane, said playhouse further comprising:

a fourth roof sheet disposed upon said upper and second lower tie beams in partially overlapping relation with said second roof sheet, said fourth roof sheet having an upper edge oriented longitudinally along said upper tie beam to define an extension of said roof ridge with the upper edge of said third roof sheet, wherein seventh and eighth holes are defined through said fourth roof sheet at longitudinally spaced locations adjacent its upper edge, the spacing between said seventh and eighth holes being substantially the same as the predetermined spacing between said second and third recess notches such that said seventh and eighth holes overlie said bores in the second top surface of said second and third roof peak pieces, respectively, and said seventh hole is aligned with said fourth hole in said second roof sheet such that said fourth roof peg extends through said fourth and seventh holes into the bore in said second top surface of said second roof peak piece; and a sixth roof peg extending through said eighth hole into said bore in said second top surface of said third roof peak piece to mount said fourth roof sheet to said upper tie beam via said second and third roof peak pieces.

5. The playhouse according to claim 1 wherein said upper tie beam has at least a third of said recess notches opening upward at a location spaced longitudinally from said second recess notch by said predetermined distance, said playhouse further comprising:

a third roof peak piece disposed in said third recess notch of said upper tie beam and including: a bottom edge having a recess notch defined therein and configured to interlock with said third recess notch in said upper tie beam; and a top edge having at least one top surface oriented substantially at said acute angle to horizontal, said roof peak piece having a bore defined therein through said one top surface;

a second roof sheet disposed upon and extending between said upper and first lower tie beams in partial overlapping relation with said first roof sheet, said second roof sheet having an upper edge oriented longitudinally along said upper tie beam, wherein third and fourth holes are defined through said second roof sheet at longitudinally spaced locations adjacent its upper edge, the spacing between said third and fourth holes being substantially the same as the predetermined spacing between said first and second recess notches such that said third and fourth holes overlie said bores in said second and third roof peak pieces, respectively, and said third hole is aligned with said second hole in said first roof sheet such that said second roof peg extends through said second and third holes into the bore in said one top surface of said second roof peak piece; and a third roof peg extending through said fourth hole in said second roof sheet and into said bore in said third roof peak piece to mount said second roof sheet on said upper tie beam via said second and third roof peak pieces.

6. The playhouse according to claim 5 further comprising:

a second lower tie beam extending parallel to said first lower tie beam at a location lower than and transversely displaced from said first lower tie beam in the same sense that said first lower tie beam is transversely displaced from said upper tie beam, thereby to provide an extension of said first plane;

wherein said first lower tie beam has at least a fourth and a fifth of said recess notches opening upwardly at locations longitudinally spaced by said predetermined distance and transversely aligned with said second and third recess notches, respectively, in said upper tie beam;

fourth and fifth roof peak pieces disposed in said fourth and fifth recess notches, respectively, of said first lower tie beam, said fourth and fifth roof peak pieces each including: a bottom edge having a recess notch defined therein and configured to interlock with a respective one of said fourth and fifth recess notches in said first lower tie beam; and a top edge having at least one top surface oriented substantially at said acute angle to horizontal, said roof peak piece having a bore defined therein through said one top surface;

a third roof sheet disposed upon and extending between said first and second lower tie beams, said third roof sheet having an upper edge oriented longitudinally along said first lower tie beam, wherein fifth and sixth holes are defined through said third roof sheet at longitudinally spaced locations adjacent its upper edge, the spacing between said fifth and sixth holes being substantially the same as the predetermined spacing between said fourth and fifth recess notches such that said fifth and sixth holes overlie said bores in said fourth and fifth roof peak pieces, respectively; and fourth and fifth roof pegs extending through said fourth and fifth holes, respectively, in said third roof sheet and into said bores in said fourth and fifth roof peak pieces, respectively, to mount said third roof sheet on said first lower tie beam via said third and fourth roof peak pieces.

7. The playhouse according to claim 6 wherein said bores defined at said top surfaces of said roof peak pieces extend perpendicular to said top surfaces.

8. The playhouse according to claim 1 wherein said first and second walls are opposite gable ends of said playhouse.

9. The playhouse according to claim 1 wherein said bores defined at said top surfaces of said roof peak pieces extend perpendicular to said top surfaces.

10. A roof peak piece for use in securing roof sheets atop a child's playhouse constructed of interlocking log-like members that inter-engage by standardly configured recess notches defined in edges of the members, said roof peak piece comprising:

a body having front and back surfaces defining a thickness dimension therebetween, a bottom edge, two side edges and first and second top surfaces converging upwardly from respective side edges to a linear top edge, wherein one of said standardly configured recess notches is defined in said bottom edge entirely through said thickness dimension, and wherein each of said first and second top surfaces has a respective bore defined therein adapted to receive a peg extending through a hole in said roof sheet.

11. The roof peak piece according to claim 10 wherein said one recess notch subdivides said bottom edge into two substantially identical horizontal coplanar sections, and wherein said body is symmetrical about a vertical plane extending through said linear top edge and said one recess notch.

12. The roof peak piece according to claim 11 wherein the roof of said playhouse is sloped at a predetermined angle relative to horizontal, and wherein said first and second top surfaces are oriented at said predetermined angle relative to said bottom edge.

13. In combination with said roof peak piece according to claim 12, a roof sheet of generally rectangular configuration having two holes defined therein at respective locations spaced along and adjacent one edge of said sheet, the spacing between said holes being predetermined; and a roof peg having a stem portion configured to be extended through one of said holes in said roof sheet and into one of the bores in said roof peak piece.

14. A child's playhouse of the type that is readily assembled, disassembled and enterable by five to twelve year old children, said playhouse comprising:

first and second longitudinally spaced walls;

an upper tie beam extending between and supported by said walls, said upper tie beam having at least first, second and third upwardly open recess notches of substantially identical configuration disposed along its length at predetermined equally spaced intervals;

a first lower tie beam extending between and supported by said walls at a location below and transversely displaced from said upper tie beam, said upper and lower tie beams being parallel to one another to define a first sloped plane at an acute angle to horizontal;

first, second and third roof peak pieces disposed in said first, second and third recess notches, respectively, in interlocking engagement with said upper tie beam, each of said roof peak pieces comprising: a bottom edge having a recess notch defined therein and configured to interlock with a respective one of said first and second recess notches in said upper tie beam; and a top edge having at least one top surface oriented substantially at said acute angle to horizontal, said roof peak piece having a bore defined therein at said one top surface;

a first roof sheet disposed upon and extending between said upper and lower tie beams, said roof sheet having an upper edge oriented longitudinally along said upper tie beam, wherein first and second holes are defined through said roof sheet at longitudinally spaced locations adjacent said upper edge, the spacing between said holes being substantially the same as the predetermined spacing between said first and second recess notches such that said first and second holes overlie said bores in said first and second roof peak pieces, respectively;

a second roof sheet disposed above the extending between said upper and first lower tie beams such that a side edge of said second roof sheet overlaps a side edge of said first roof sheet, said second roof sheet having an upper edge oriented longitudinally along said upper tie beam, wherein third and fourth holes are defined through said second roof sheet at longitudinally spaced locations adjacent it supper edge, the spacing between said third and fourth holes being substantially the same as the predetermined spacing between said second and third recess notches, whereby the third and fourth holes overlie said bores in said second and third roof pieces, respectively, and said third hole is aligned with the second hole in said first roof sheet; and first, second and third roof pegs removably extending into said bores in said first, second and third roof peak pieces, respectively, wherein said first roof peg passes through said first hole to partially secure said first roof sheet to said first roof peak piece, wherein said second roof peg passes through said second and third holes to partially secure said first and second roof sheets to said second roof peak piece, and wherein said third roof peg passes through said third hole to partially secure said second roof sheet to said third roof peak piece;

wherein the playhouse is scaled to permit children to enter and play interiorly thereof.

* * * * *